US012612678B2

(12) United States Patent
Kim et al.

(10) Patent No.: US 12,612,678 B2
(45) Date of Patent: Apr. 28, 2026

(54) SOLVENT EXTRACTION METHOD USING TWO-STAGE EXTRACTION FOR SEPARATION AND RECOVERY OF NICKEL, COBALT, AND MANGANESE

(71) Applicant: ECOPRO MATERIALS, CO., LTD., Pohang-si (KR)

(72) Inventors: Dong Hee Kim, Pohang-si (KR); Yong Hun Kim, Pohang-si (KR); Woo Jin Kim, Pohang-si (KR)

(73) Assignee: ECOPRO MATERIALS, CO., LTD., Pohang-si (KR)

( * ) Notice: Subject to any disclaimer, the term of this patent is extended or adjusted under 35 U.S.C. 154(b) by 700 days.

(21) Appl. No.: 18/011,321

(22) PCT Filed: Feb. 28, 2022

(86) PCT No.: PCT/KR2022/002846
§ 371 (c)(1),
(2) Date: Dec. 19, 2022

(87) PCT Pub. No.: WO2023/158008
PCT Pub. Date: Aug. 24, 2023

(65) Prior Publication Data

US 2024/0117461 A1 Apr. 11, 2024

(30) Foreign Application Priority Data

Feb. 17, 2022 (KR) ..... 10-2022-0020918

(51) Int. Cl.
*C22B 3/26* (2006.01)
*C22B 3/08* (2006.01)
*C22B 47/00* (2006.01)

(52) U.S. Cl.
CPC ..... *C22B 3/26* (2021.05); *C22B 3/08* (2013.01); *C22B 47/00* (2013.01)

(58) Field of Classification Search
None
See application file for complete search history.

(56) References Cited

U.S. PATENT DOCUMENTS

| | | | |
|---|---|---|---|
| 10,995,014 | B1 | 5/2021 | Fraser |
| 2013/0192425 | A1 | 8/2013 | Sonu et al. |
| 2019/0152797 | A1 | 5/2019 | Liu et al. |

FOREIGN PATENT DOCUMENTS

| | | | |
|---|---|---|---|
| CA | 3182557 | A1 | 1/2022 |
| CN | 102181665 | A * | 9/2011 |

(Continued)

OTHER PUBLICATIONS

English translation of CN-113443664-A Description. (Year: 2021).*

(Continued)

*Primary Examiner* — Anthony J Zimmer
*Assistant Examiner* — Zachary John Baum
(74) *Attorney, Agent, or Firm* — Bridgeway IP Law Group, PLLC; Jihun Kim

(57) ABSTRACT

Proposed is a solvent extraction method using two-stage extraction for separation and recovery of nickel, cobalt, and manganese. More specifically, the method relates to a two-stage extraction-based solvent extraction method for separately recovering nickel, cobalt, and manganese from a starting material containing nickel, cobalt, and manganese. The method includes a first solvent extraction step in which manganese is recovered from the starting material and a second solvent extraction step in which nickel and cobalt are extracted from the starting material so that three kinds of valuable metals can be separately recovered.

18 Claims, 2 Drawing Sheets

(56) References Cited

FOREIGN PATENT DOCUMENTS

| | | | | | |
|---|---|---|---|---|---|
| CN | 110616331 | A | | 12/2019 | |
| CN | 111519031 | A | | 8/2020 | |
| CN | 112375910 | A | | 2/2021 | |
| CN | 112662878 | A | | 4/2021 | |
| CN | 113443664 | A | * | 9/2021 | ..... C01G 53/10 |
| JP | 2010-180439 | A | | 8/2010 | |
| JP | 2020-105598 | A | | 7/2020 | |
| KR | 10-1535250 | B1 | | 7/2015 | |
| KR | 10-2245002 | B1 | | 4/2021 | |
| KR | 10-2324910 | B1 | | 11/2021 | |

OTHER PUBLICATIONS

English translation of CN-112375910-A Description. (Year: 2021).*
Bhar, M., et al. A review on spent lithium-ion battery recycling: from collection to black mass recovery. RSC Sustainability, 2023, 1, 1150. (Year: 2023).*
English translation of CN-102181665-A Description. (Year: 2011).*
Alvial Hein Guillermo et al., "Separation and recovery of cobalt and nickel from end of life products via solvent extraction technique", Journal of Cleaner Production, vol. 297, 126592, Mar. 3, 2021.
P.T.Davey et al., "Removal of Iron From Leach Liquors by the "Goethite" Process", Hydrometallurgy, vol. 2, 25-33, Dec. 15, 1975.
Bij Na Kim Lee, "Supplementary European Search Report for EP Application No. 22 82 1837", Jul. 24, 2024, EPO.

* cited by examiner

SOLVENT EXTRACTION METHOD USING TWO-STAGE EXTRACTION FOR SEPARATION AND RECOVERY OF NICKEL, COBALT, AND MANGANESE

TECHNICAL FIELD

The present invention relates to a solvent extraction method using two-stage extraction for separation and recovery of nickel (Ni), cobalt (Co), and manganese (Mn) and, more specifically, to a solvent extraction method using two-stage extraction for separation and recovery of Ni, Co, and Mn of recovering Mn through a first solvent extraction step and separating and recovering each of Ni and Co through a second solvent extraction step using a starting material containing Ni, Co, and Mn so that three types of valuable metals can be individually separated and recovered.

BACKGROUND ART

As the lithium secondary battery industry is positioned as a core technology in various application fields ranging from smartphones, tablet PCs, electric vehicles, energy storage devices and the like, its industrial importance is increasing. Lithium secondary batteries, which are mainly applied to portable electronic devices, are being actively researched and developed as concerns about the global environment and the depletion of fossil fuel increase. It is expected that the demand for lithium secondary batteries will further increase as the electric vehicle market expands in the future.

Valuable metals including Ni, Co, and Mn used as cathode active materials of these lithium secondary batteries can be recovered through a hydrometallurgical process.

However, the existing hydrometallurgical process for recovery of valuable metals including Ni, Co, and Mn has limitations in that valuable metals are separated into alloys of two types of metals such as nickel/cobalt (Ni/Co) and nickel/manganese (Ni/Mn), or are separated into a single metal and an alloy of two types of metals such as nickel/cobalt (Ni/Co) and manganese (Mn), that is, it is impossible to separate the three types of valuable metals individually.

Further, while a caustic method using sodium hydroxide (NaOH), sodium carbonate ($Na_2CO_3$), or sodium sulfate ($Na_2SO_4$) are used to increase the pH in the extraction process in the existing hydrometallurgical process, sodium produced in the form of a metal salt causes a decrease in process efficiency.

DISCLOSURE

Technical Problem

The present invention has been devised to address the aforementioned issues, and an objective of the present invention is to provide a solvent extraction method using two-stage extraction for separation and recovery of Ni, Co, and Mn. In the method, a starting material including Ni, Co, and Mn is used, and a two-stage hydrometallurgical extraction process including the first solvent extraction step and the second solvent extraction step is applied, so that valuable metals composed of Ni, Co, and Mn can be individually separated and recovered with high purity.

The objective of the present disclosure is not limited to the objective mentioned above. The objectives of the present disclosure will become more apparent from the following description and will be realized by means and combinations thereof described in the claims.

Technical Solution

In order to achieve the above-described objective, the present invention provides a solvent extraction method using two-stage extraction for separation and recovery of Ni, Co, and Mn, and the method includes: a raw material leachate preparation step of preparing a raw material leachate including Ni, Co, and Mn; a first solvent extraction step of separating Mn contained in the raw material leachate as a manganese sulfate aqueous solution ($MnSO_4$); and a second solvent extraction step of separating Ni and Co contained in the raw material leachate from which Mn is separated as a nickel sulfate aqueous solution ($NiSO_4$) and a cobalt sulfate aqueous solution ($CoSO_4$), respectively. Three types of valuable metals including the Ni, Co, and Mn are individually separated and recovered.

In a preferred embodiment, the raw material leachate preparation step includes: a cleaning step of washing a starting material including Ni, Co, and Mn with washing water; a first solid-liquid separation step of separating the washed starting material into a starting material cake and a filtrate; a leaching step of adding sulfuric acid to the starting material cake for reaction; an iron precipitation step of adding hydrogen peroxide and nickel hydroxide ($Ni(OH)_2$) to a reaction product formed through the leaching step to precipitate an iron component; and a second solid-liquid separation step of separating reaction products formed through the iron precipitation step into a precipitate including iron and a raw material leachate including Ni, Co, and Mn.

In a preferred embodiment, the first solvent extraction step includes: a first preloading step of adding a nickel sulfate aqueous solution ($NiSO_4$) to a first solvent to generate a manganese extracting solvent; a first-first extraction step of adding the raw material leachate to the manganese extracting solvent to separate the manganese extracting solvent into a first organic phase solution including Ni, Co, and Mn and a first aqueous phase solution including Ni and Co; a first-second extraction step of separating the first organic phase solution into a second organic phase solution including Mn and a second aqueous phase solution including Ni and Co; a first-first back-extraction step of back-extracting Mn remaining in the second organic phase solution to separate the second organic phase solution into a third organic phase solution not containing Mn and a third aqueous phase solution containing Mn, thereby obtaining a manganese sulfate aqueous solution ($MnSO_4$) from the third aqueous phase solution; and a first-second back-extraction step of back-extracting impurities contained in the third organic phase solution to separate the third organic phase solution into a fourth organic phase solution not containing impurities and a fourth aqueous phase solution containing the impurities.

In a preferred embodiment, the second solvent extraction step includes: a second preloading step of adding a nickel sulfate aqueous solution ($NiSO_4$) to a second solvent to generate a nickel and cobalt extracting solvent; a second-first extraction step of adding the first aqueous phase solution including Ni and Co to the nickel and cobalt extracting solvent to separate the nickel and cobalt extracting solvent into a fifth organic phase solution including Ni and Co and a fifth aqueous phase solution including Ni, thereby obtaining a nickel sulfate aqueous solution ($NiSO_4$) from the fifth aqueous phase solution; a second-second extraction step of separating the fifth organic phase solution into a sixth organic phase solution including Co and a sixth aqueous phase solution including Ni; a second-first back-extraction step of back-extracting Co remaining in the sixth organic phase solution to separate the sixth organic phase solution into a seventh organic phase solution not containing Co and a seventh aqueous phase solution containing Co, thereby obtaining a cobalt sulfate aqueous solution ($MnSO_4$) from the seventh aqueous phase solution; and a second-second back-extraction step of back-extracting impurities contained in the seventh organic phase solution to separate the seventh organic phase solution into an eighth organic phase solution not containing impurities and an eighth aqueous phase solution containing the impurities.

In a preferred embodiment, the fourth organic phase solution obtained through the separation of the first-second back-extraction step is reused as the first solvent in the first preloading step.

In a preferred embodiment, the eighth organic phase solution obtained through the separation of the second-second back-extraction step is reused as the second solvent in the second preloading step.

In a preferred embodiment, a phosphoric extractant is used as the first solvent.

In a preferred embodiment, the manganese extracting solvent has a pH adjusted to 5.0 to 5.5 in the first preloading step.

In a preferred embodiment, the reaction is performed at a pH in a range of 4.5 to 5.0 in the first-first extraction step.

In a preferred embodiment, the reaction is performed at a pH in a range of 3.0 to 4.0 in the first-second extraction step.

In a preferred embodiment, the reaction is performed at a pH in a range of 1.0 to 1.5 in the first-first back-extraction step.

In a preferred embodiment, a phosphinic extractant or a phosphonic extractant is used as the second solvent.

In a preferred embodiment, the nickel and cobalt extracting solvent has a pH adjusted to 6.0 to 6.5 in the second preloading step.

In a preferred embodiment, the reaction is performed at a pH in a range of 5.5 to 6.0 in the second-first extraction step.

In a preferred embodiment, the reaction is performed at a pH in a range of 4.5 to 5.0 in the second-second extraction step.

In a preferred embodiment, the reaction is performed at a pH in a range of 2.0 to 2.5 in the second-first back-extraction step.

In a preferred embodiment, the method further includes a nickel hydroxide preparation step of recovering a first raffinate including Ni produced through the first preloading step, a second raffinate including Ni and Co produced through the second preloading step, and the sixth aqueous phase solution produced through the second-second extraction step to prepare nickel hydroxide.

In a preferred embodiment, the nickel hydroxide produced through the nickel hydroxide preparation step is used in the iron precipitation step.

In a preferred embodiment, the starting material is a mixed hydroxide precipitate (MHP, $Me(OH)_2$), a mixed carbonate precipitate (MCP, $MeCO_3$), a mixed sulfide or sulfate precipitate (MSP, MeS, or $MeSO_4$) or black powder (BP), here, Me is Ni, Co, or Mn.

Advantageous Effects

The present invention has the following excellent effects.

According to a solvent extraction method using two-stage extraction for separation and recovery of Ni, Co, and Mn of the present invention, Mn is recovered through a first solvent extraction step, and each of Ni and Co is separated and recovered through a second solvent extraction step using a starting material containing Ni, Co, and Mn, so that three types of valuable metals can be individually separated and recovered.

In addition, according to a solvent extraction method using two-stage extraction for separation and recovery of Ni, Co, and Mn of the present invention, when a preloading process of adding a nickel sulfate aqueous solution ($NiSO_4$) obtained through the second solvent extraction step to the solvent is applied, Ni is transferred in an organic phase to the solvent to increase the recovery rate of valuable metals. Further, the pH of the solvent can increase before the solvent extraction step, and thus it is possible to minimize the amount of the used neutralizing agent for the increase in pH, thereby preventing the reduction in process efficiency due to the formation of metal salts.

Furthermore, according to a solvent extraction method using two-stage extraction for separation and recovery of Ni, Co, and Mn of the present invention, nickel hydroxide used in the iron precipitation step is prepared from a waste liquid generated during a reaction process to minimize the loss of nickel components discarded as a waste liquid. Further, since sodium hydroxide or sodium carbonate is not used as a neutralizing agent, the process efficiency of the solvent extraction step can increase by preventing the precipitation of impurities in the form of salts in the solvent extraction step.

BEST MODE

Figure 1:
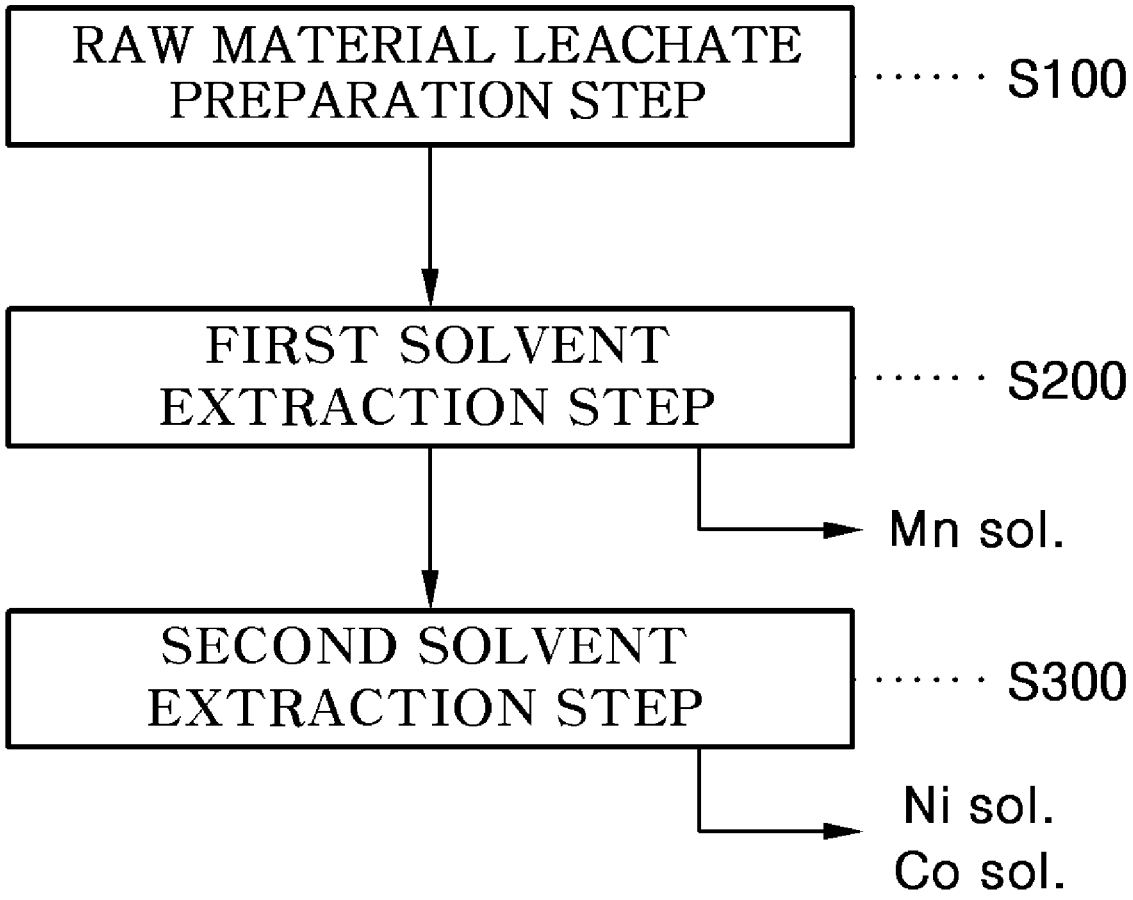
FIG. 1 is a summary flow chart of a solvent extraction method using two-stage extraction for separation and recovery of Ni, Co, and Mn according to an embodiment of the present invention.

Although terms used in the embodiments are selected from general terms that are currently used, an applicant may arbitrarily suggest terms in specific cases. Since the terms suggested by the applicant will be described in detail in relation to operations and meanings in a corresponding description part of the embodiments, the embodiments should be understood in relation to the operations and meanings represented in the terms instead of names of the terms.

Example embodiments will now be described more fully hereinafter with reference to the accompanying drawings.

However, the present invention may be embodied in different forms and should not be construed as limited to the embodiments set forth herein. Like reference numerals refer to like elements throughout.

Figure 2:
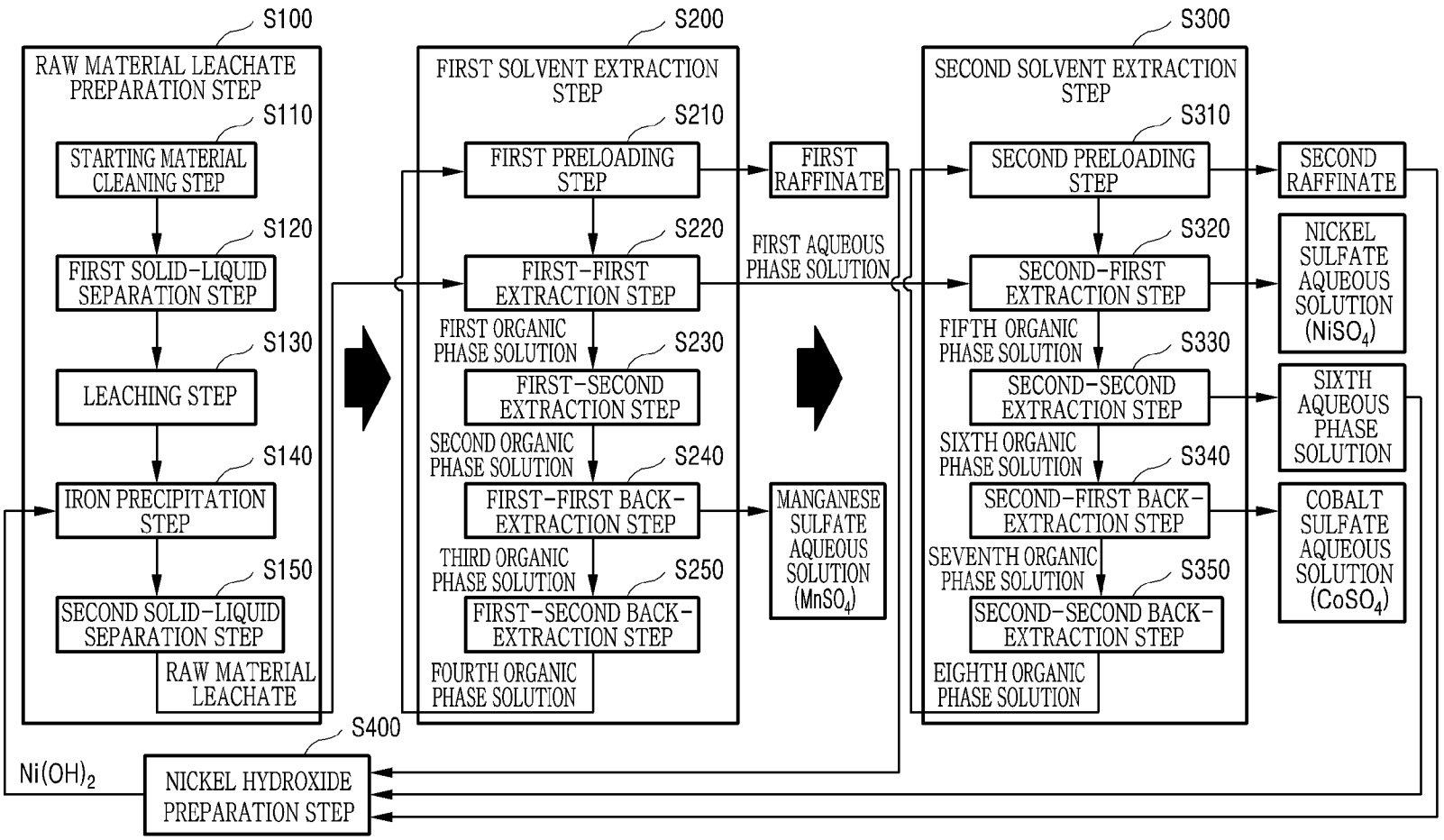
FIG. 2 is a flow chart for explaining a raw material leachate preparation step, a first solvent extraction step, a second solvent extraction step, and a nickel sulfate preparation step of FIG. 1.

FIG. 1 is a summary flow chart of a solvent extraction method using two-stage extraction for separation and recovery of Ni, Co, and Mn according to an embodiment of the present invention, and FIG. 2 is a flow chart for explaining a raw material leachate preparation step, a first solvent extraction step, a second solvent extraction step, and a nickel sulfate preparation step of FIG. 1.

Referring to FIGS. 1 and 2, a solvent extraction method using two-stage extraction for separation and recovery of Ni, Co, and Mn according to an embodiment of the present invention includes a raw material leachate preparation step (S100), a first solvent extraction step (S200), and a second solvent extraction step (S300). In the method, Mn is recovered through the first solvent extraction step (S200), and each of Ni and Co is separated and recovered through the second solvent extraction step (S300) using a staring material including Ni, Co, and Mn, so that three types of valuable metals may be individually separated and recovered.

The raw material leachate preparation step (S100) is a process of preparing a raw material leachate containing Ni, Co, and Mn. First, a cleaning step (S110) of pre-washing the starting material with washing water is carried out.

Here, the starting material is not limited as long as it is a starting material containing Ni, Co, and Mn. For example, an MEW ($Me(OH)_2$), an MCP ($MeCO_3$), an MSP (MeS or $MeSO_4$) or BP may be used. Here, Me is Ni, Co, or Mn.

Furthermore, in the cleaning step (S110), the volume ratio of the starting material and the washing water is preferably in the range of 1:1 to 1:5, and impurities such as Ca, Mg, Al, Na, Li and the like contained in the starting material are removed. Particularly, Na is removed to 200 ppm or less.

Next, a first solid-liquid separation step (S120) of separating the starting material washed through the cleaning step (S110) into a starting material cake and a filtrate is performed.

In the first solid-liquid separation step (S120), water may be additionally introduced, and impurities remaining on the surface are removed after filtration.

Next, a leaching step (S130) of adding sulfuric acid to the starting material cake obtained from the separation of the first solid-liquid separation step (S120) for reaction is carried out.

In the leaching step (S130), the equivalent ratio of the metals (Ni, Co, Mn, Cu, Fe, and Al) of the starting material cake and the sulfuric acid is preferably in the range of 1:0.5 to 1:2.

In addition, the leaching step (S130) may include a first leaching step (S131) and a second leaching step (S132).

Here, the first leaching step (S131) is a pulping process for partially dissolving the starting material, in which sulfuric acid is added to the starting material cake for reaction.

Further, in the first leaching step (S131), about 65% of the total amount of sulfuric acid used in the leaching step (S130) is used, and the control of reactivity is performed to suppress the generation of sulfur gas and to control the exothermic reaction.

Furthermore, the second leaching step (S132) is for completely dissolving the first leachate formed through the first leaching step (S131), in which hydrogen peroxide is added for reaction.

In addition, the equivalent ratio of the metal component composed of Mn and Co of the first leachate and the hydrogen peroxide is preferably in the range of 1:0.5 to 1:2. Here, the hydrogen peroxide serves to reduce and leach insoluble $Mn^{4+}$ and $Co^{3+}$.

Further, about 35% of the total amount of sulfuric acid used in the leaching step (S130) is used in the second leaching step (S132).

Next, an iron precipitation step (S140) of adding hydrogen peroxide and nickel hydroxide ($Ni(OH)_2$) to reaction products formed through the leaching step (S130) to precipitate an iron component (S140) is performed.

Furthermore, the equivalent ratio of iron in the leachate and the hydrogen peroxide is in the range of 1:0.5 to 1:3 in the iron precipitation step (S140). Here, the hydrogen peroxide oxidizes Fe as the impurity to trivalent Fe to induce the precipitation of hematite ($Fe_2O_3$) or goethite (FeOOH).

In addition, the nickel hydroxide allows the pH to increase from 3.5 to 6.5 to serve to precipitate impurities containing Fe and Al in the iron precipitation step (S140).

On the other hand, as the nickel hydroxide, nickel hydroxide prepared by recycling a raffinate or the like generated in the first solvent extraction step (S200) and the second solvent extraction step (S300), which will be described later, may be used. A detailed description thereof will be given later.

Next, a second solid-liquid separation step (S150) of separating the reaction products formed through the iron precipitation step (S140) into a precipitate containing iron and a raw material leachate containing Ni, Co, and Mn is performed.

The first solvent extraction step (S200) is a process for separating Mn contained in the raw material leachate as a manganese sulfate aqueous solution ($MnSO_4$). First, a preloading step (S210) of adding a nickel sulfate aqueous solution ($NiSO_4$) to a first solvent to produce a manganese extracting solvent is carried out.

Here, the nickel sulfate aqueous solution ($NiSO_4$) may be a nickel sulfate aqueous solution ($NiSO_4$) separated and recovered in the second solvent extraction step (S300) to be described later. Accordingly, the recovery rate of valuable metals may increase since the nickel component is transferred in the organic phase to the first solvent. Further, the pH of the first solvent may increase before the solvent extraction step to minimize the amount of the neutralizing agent used for the increase in pH, thereby preventing the decrease in process efficiency due to the formation of metal salts.

In addition, the first solvent may be a phosphoric extractant, but is not limited as long as it is a solvent which exhibits similar behavior to Ni and Co according to a pH, and is capable of separating Mn. Examples thereof include extractants such as di-2-ethylhexyl phosphoric acid, sulfanyl-sulfanylidene-bis[(2R)-2,4,4-trimethylpentyl]-λ5-phosphane, bis(5,8,12,15-tetraoxanonadecan-10-yl) phosphoric acid, bis(1,3-diisobutoxypropan-2-yl) phosphoric acid, etc.

Further, the pH of the manganese extracting solvent is preferably adjusted to 5.0 to 5.5 in the first preloading step (S210).

Next, a first-first extraction step (S220) of adding the raw material leachate to the manganese extracting solvent to separate the manganese extracting solvent into a first organic phase solution containing Ni, Co, and Mn and a first aqueous phase solution containing Ni and Co is carried out.

To this end, the reaction is performed at a pH in a range of 4.5 to 5.0 in the first-first extraction step (S220).

Next, a first-second extraction step (S230) of separating the first organic phase solution into a second organic phase solution containing Mn and a second aqueous phase solution containing Ni and Co is carried out.

Here, the reaction is performed at a pH in a range of 3.0 to 4.0 in the first-second extraction step (S230).

Next, a first-first back-extraction step (S240) of back-extracting Mn remaining in the second organic phase solution and separating the second organic phase solution into a third organic phase solution not containing Mn and a third aqueous phase solution containing Mn to obtain a manganese sulfate aqueous solution ($MnSO_4$) from the third aqueous phase solution is carried out.

Here, the reaction is performed at a pH in a range of 1.0 to 1.5 in the first-first back-extraction step (S240).

Next, a first-second back-extraction step (S250) of back-extracting impurities contained in the third organic phase solution and separating the third organic phase solution into a fourth organic phase solution not containing impurities and a fourth aqueous phase solution containing impurities is carried out.

Here, the reaction is performed at a pH less than 1.0 in the first-second back-extraction step (S250).

Accordingly, since impurity metals such as sodium (Na) and iron (Fe) contained in the third organic phase solution are transferred to the fourth aqueous phase solution, the fourth organic phase solution from which impurities remaining in the third organic phase solution are removed is obtained, and thus the fourth organic phase solution may be reused as the first solvent of the first preloading step.

The second solvent extraction step (S200) is a process for separating Ni and Co contained in the raw material leachate from which Mn is separated as a nickel sulfate aqueous solution ($NiSO_4$) and a cobalt sulfate aqueous solution ($CoSO_4$), respectively. First, a second preloading step (S310) of adding the nickel sulfate aqueous solution ($NiSO_4$) to the second solvent to generate a nickel and cobalt extracting solvent is performed.

Here, the nickel sulfate aqueous solution ($NiSO_4$) may be a nickel sulfate aqueous solution ($NiSO_4$) separated and recovered through a second-first extraction step (S320) to be described later. Accordingly, the recovery rate of valuable metals may increase since the nickel component is transferred to the organic phase in a second solvent. Further, the pH of the second solvent may increase before the solvent extraction step to minimize the amount of the neutralizing agent used for the increase in pH, thereby preventing the decrease in process efficiency due to the formation of metal salts.

In addition, the second solvent may be a phosphinic or phosphonic extractant, but is not limited as long as it is a solvent which exhibits similar behavior to Co and Mn according to a pH, and is capable of separating Ni. Examples thereof include extractants such as bis-2,4,4-trimethylpentyl phosphinic acid, 2-ethylhexyl 2-ethylhexyphosphonic acid, 2-ethylhexyl phosphonic acid mono-2-ethylhexyl ester, etc.

Furthermore, the pH of the nickel and cobalt extracting solvent is preferably adjusted to 6.0 to 6.5 in the second preloading step (S310).

Next, a second-first extraction step (S320) of adding the first aqueous phase solution containing Ni and Co to the nickel and cobalt extracting solvent, and separating a fifth organic phase solution containing Ni and Co and a fifth aqueous phase solution containing (Ni) to obtain a nickel sulfate aqueous solution ($NiSO_4$) from the fifth aqueous phase solution is carried out.

To this end, the reaction is performed at a pH in a range of 5.5 to 6.0 in the second-first extraction step (S320).

Next, a second-second extraction step (S330) of separating the fifth organic phase solution into a sixth organic phase solution containing Co and a sixth aqueous phase solution containing Ni is carried out.

Here, the reaction is performed at a pH in a range of 4.5 to 5.0 in the second-second extraction step (S330).

Next, a second-first back-extraction step (S340) of back-extracting Co remaining in the sixth organic phase solution and separating the sixth organic phase solution into a seventh organic phase solution not containing Co and a seventh aqueous phase solution containing Co to obtain a cobalt sulfate aqueous solution ($CoSO_4$) from the seventh aqueous phase solution is carried out.

Here, the reaction is performed at a pH in a range of 2.0 to 2.5 in the second-first back-extraction step (S340).

Next, a second-second back-extraction step (S350) of back-extracting impurities contained in the seventh organic phase solution and separating the seventh organic phase solution into an eighth organic phase solution not containing impurities and an eighth aqueous phase solution containing impurities is carried out.

Here, the reaction is performed at a pH less than 1.0 in the second-second back-extraction step (S350).

Accordingly, since impurity metals such as sodium (Na) and iron (Fe) contained in the seventh organic phase solution are transferred to the eighth aqueous phase solution, the eighth organic phase solution from which impurities remaining in the seventh organic phase solution are removed is obtained, so that the eighth organic phase solution may be reused as the second solvent of the second preloading step (S310).

Therefore, according to a solvent extraction method using two-stage extraction for separation and recovery of Ni, Co, and Mn of the present invention, Mn contained in the raw material leachate may be separated as a manganese sulfate aqueous solution ($MnSO_4$) through the first solvent extraction step, and each of Ni and Co may be separated as a nickel sulfate aqueous solution ($NiSO_4$) and a cobalt sulfate aqueous solution ($CoSO_4$) through the second solvent extraction step using a starting material containing Ni, Co, and Mn, and thus, three types of valuable metals may be individually separated and recovered.

In addition, a solvent extraction method using two-stage extraction for separation and recovery of Ni, Co, and Mn of the present invention may further include a nickel hydroxide preparation step (S400).

The nickel hydroxide preparation step (S400) is a process for preparing nickel hydroxide by recycling by-products generated during the reaction process. The nickel hydroxide preparation step (S400) is carried out sequentially through a nickel hydroxide precipitation step, a third solid-liquid separation step, and a cleaning step.

Here, in the nickel hydroxide precipitation step, 10% sodium hydroxide (NaOH) is added to adjust the pH to 7.0 to 9.0 to enable precipitation of nickel hydroxide for complete precipitation of a first raffinate containing Ni produced through the first preloading step, a second raffinate containing Ni produced through the second preloading step, and Ni contained in the sixth aqueous phase solution produced through the second-second extraction step.

Thereafter, a third solid-liquid separation step of separating the reaction products generated through the nickel hydroxide precipitation step into a nickel hydroxide precipitate and a filtrate is carried out.

Next, a cleaning step is performed to obtain nickel hydroxide by washing the separated nickel hydroxide precipitate with water to remove residual sodium.

In this way, the nickel hydroxide ($Ni(OH)_2$) prepared through the nickel hydroxide preparation step (S400) is used in the iron precipitation step (S140).

Therefore, according to a solvent extraction method using two-stage extraction for separation and recovery of Ni, Co, and Mn of the present invention, nickel hydroxide used in the iron precipitation step is prepared by reusing by-products generated during the reaction process to minimize the loss of nickel components discarded as a waste liquid. Further, since sodium hydroxide or sodium carbonate is not used as a neutralizing agent in the iron precipitation step (S140), the process efficiency of the solvent extraction step may increase by preventing the precipitation of impurities in the form of salts in the solvent extraction step.

EXAMPLES

Example 1 (Raw Material Leachate Preparation Step)

100 parts by weight of a starting material (Ni-MHP) containing Ni, Co, and Mn was cleaned with 100 parts by weight of washing water, and solid-liquid separation was performed to obtain a washed residue.

Here, the raw material composition of an MHP ($Me(OH)_2$) as the starting material is shown in Table 1 below (Me is Ni, Co, or Mn).

TABLE 1

| Raw material | Composition (%) |
|---|---|
| Ni | 35~40 |
| Co | 1~5 |
| Mn | 1~5 |
| Cu | 0.1~0.2 |
| Zn | 0.1~0.5 |
| Ca | 0.1~0.3 |
| Mg | 1~3 |
| Fe | 0.1~0.5 |
| Al | 0.1~0.5 |
| Na | 0.1~0.5 |
| Moisture content | 50~55 |

Thereafter, 160 parts by weight of water and 30 parts by weight of 98% sulfuric acid were added to 100 parts by weight of the washing residue for reaction. At this time, the equivalent ratio of the metals (Ni, Co, Mn, Cu, Fe, and Al) contained in the washing residue and the sulfuric acid is 1:1.1. Next, 15 parts by weight of 98% sulfuric acid and 3 parts by weight of 32% hydrogen peroxide were added to 290 parts by weight of the primary leachate for reaction.

Next, 1.5 parts by weight of 32% hydrogen peroxide and 13 parts by weight of nickel hydroxide ($Ni(OH)_2$) were added to 100 parts by weight of the obtained secondary leachate to perform the reaction so that the iron component was precipitated.

Next, the obtained reaction product was separated into a precipitate containing iron and a raw material leachate containing Ni, Co, and Mn.

Example 2 (First Solvent Extraction Step)

Di-2-ethylhexyl phosphoric acid was used as the first solvent, and a nickel sulfate aqueous solution ($NiSO_4$) was added to produce a manganese extracting solvent with a pH in a range of 5.0 to 5.5.

At this time, the first solvent and the nickel sulfate aqueous solution ($NiSO_4$) were used at a ratio of 3.5, and the first raffinate containing a small amount of Ni was produced.

Next, the raw material leachate containing Ni, Co, and Mn obtained in Example 1 was added to the manganese extracting solvent, and the reaction was performed at a pH in a range of 4.5 to 5.0, thereby separating the manganese extracting solvent into a first organic phase solution containing Ni, Co, and Mn and a first aqueous phase solution containing Ni and Co.

At this time, the composition of the first aqueous phase solution is shown in Table 2 below.

TABLE 2

| | Ni | Co | Mn |
|---|---|---|---|
| First aqueous phase solution (g/L) | 90~100 | 2~10 | 0 |

Thereafter, the first organic phase solution was adjusted to have a pH of 3.5 and separated into a second organic phase solution containing Mn and a second aqueous phase solution containing Ni and Co. Here, the composition of the second aqueous phase solution is shown in Table 3 below.

TABLE 3

| | Ni | Co | Mn |
|---|---|---|---|
| Second aqueous phase solution (g/L) | 10~15 | 20~30 | 0 |

Next, the pH was adjusted to 1.0 to 1.5 so that Mn remaining in the second organic phase solution was back-extracted. Then, the second organic phase solution was separated into the third organic phase solution not containing Mn and the third aqueous phase solution containing Mn to obtain a manganese sulfate aqueous solution ($MnSO_4$) from the third organic phase solution. Here, the composition of the third aqueous phase solution is shown in Table 4 below.

TABLE 4

| | Ni | Co | Mn |
|---|---|---|---|
| Third aqueous phase solution (g/L) | 0 | 0 | 120~130 |

Thereafter, the pH was adjusted to less than 1.0 so that impurities (Na, Fe, etc.) contained in the third organic phase solution were back-extracted. Then, the third organic phase solution was separated into the fourth organic phase solution containing no impurities and the fourth aqueous phase solution containing impurities. The separated fourth organic phase solution was reused as the first solvent in the first preloading step, and the composition of the fourth aqueous phase solution is shown in Table 5 below.

TABLE 5

| | Ni | Co | Mn |
|---|---|---|---|
| Fourth aqueous phase solution (g/L) | 0 | 0 | 0 |

Example 3 (Second Solvent Extraction Step)

Bis-(2,4,4-trimethylpentyl)phosphinic acid was used as the second solvent, and a nickel sulfate aqueous solution ($NiSO_4$) was added to produce a nickel and cobalt extracting solvent with a pH in a range of 6.0 to 6.5.

At this time, the second solvent and the nickel sulfate aqueous solution ($NiSO_4$) were used at a ratio of 4.0, and the second raffinate containing a small amount of Ni was produced.

Next, the first aqueous phase solution containing Ni and Co was added to the nickel and cobalt extracting solvent so that the reaction was performed at a pH in a range of 5.5 to 6.0. Then, the solvent was separated into the fifth organic phase solution containing Ni and Co and a fifth aqueous phase solution containing Ni to obtain a nickel sulfate aqueous solution ($NiSO_4$) from the fifth aqueous phase solution.

Here, the obtained nickel sulfate aqueous solution ($NiSO_4$) has a pH in a range of 5.5 to 6.0, and the nickel sulfate aqueous solution ($NiSO_4$) is used in the first preloading step (S210) and the second preloading step (S310).

At this time, the composition of the fifth aqueous phase solution is shown in Table 6 below.

TABLE 6

| | Ni | Co | Mn |
|---|---|---|---|
| Fifth aqueous phase solution (g/L) | 100~110 | 0 | 0 |

Thereafter, the fifth organic phase solution was adjusted to have a pH in a range of 4.5 to 5.0 and separated into a sixth organic phase solution containing Co and a sixth aqueous phase solution containing Ni. Here, the composition of the sixth aqueous phase solution is shown in Table 7 below.

TABLE 7

| | Ni | Co | Mn |
|---|---|---|---|
| Sixth aqueous phase solution (g/L) | 25~35 | 0 | 0 |

Next, the pH was adjusted to 2.0 to 2.5 so that Co remaining in the sixth organic phase solution was back-extracted. Then, the sixth organic phase solution was separated into the seventh organic phase solution not containing Co and the seventh aqueous phase contains containing Co to obtain a cobalt sulfate aqueous solution ($CoSO_4$) from the seventh aqueous phase solution. Here, the composition of the seventh aqueous phase solution is shown in Table 8 below.

TABLE 8

| | Ni | Co | Mn |
|---|---|---|---|
| Seventh aqueous phase solution (g/L) | 0 | 110~125 | 0 |

Thereafter, the pH was adjusted to less than 1.0 so that impurities (Na, Fe, etc.) contained in the seventh organic phase solution are back-extracted. Then the seventh organic phase solution was separated into the eighth organic phase solution containing no impurities and the eighth aqueous solution containing impurities. The separated eighth organic phase solution was reused as the second solvent in the second preloading step (S310), and the composition of the eighth aqueous phase solution is shown in Table 9 below.

TABLE 9

| | Ni | Co | Mn |
|---|---|---|---|
| Eighth aqueous phase solution (g/L) | 0 | 0 | 0 |

Example 4 (Nickel Hydroxide Preparation Step)

35 parts by weight of 10% NaOH was added to the first raffinate containing Ni produced through the first preloading step (S210) of Example 2, the Second raffinate containing Ni produced through the second preloading step (S310) of Example 3, and the sixth aqueous phase solution generated through the second-second extraction step (S330) of Example 3 to adjust the pH to 8.0, so that nickel hydroxide contained in the waste liquid was precipitated. Thereafter, the nickel hydroxide precipitate was separated, and then the nickel hydroxide precipitate was washed using 8.5 parts by weight of washing water to remove the remaining sodium to obtain nickel hydroxide ($Ni(OH)_2$), and the obtained nickel hydroxide was used as a neutralizing agent in the iron precipitation step (S140) of Example 1.

As described above, a solvent extraction method using two-stage extraction for separation and recovery of Ni, Co, and Mn according to the present invention includes the raw material leachate preparation step (S100), the first solvent extraction step (S200), and the second solvent extraction step (S300) so that three types of valuable metals may be individually separated and recovered.

Furthermore, when the first preloading process (S210) and the second preloading process (S310) of adding a nickel sulfate aqueous solution ($NiSO_4$) obtained through the reaction process to the solvent is applied, Ni is transferred in an organic phase to the solvent to increase the recovery rate of valuable metals, the pH of the solvent may increase, and thus it is possible to minimize the amount of the used neutralizing agent for the increase in pH, thereby preventing the reduction in process efficiency due to the formation of metal salts.

Further, according to a solvent extraction method using two-stage extraction for separation and recovery of Ni, Co, and Mn of the present invention, nickel hydroxide used in the iron precipitation step is prepared using the first raffinate, the second raffinate, and the sixth aqueous phase solution, which are by-products generated during the reaction process, and the prepared nickel hydroxide is used as a neutralizing agent in the iron precipitation step (S140) to minimize the loss of nickel components discarded as a waste liquid. Further, since sodium hydroxide (NaOH), sodium carbonate ($Na_2CO_3$) or sodium sulfate ($Na_2SO_4$) is not used as a neutralizing agent, the process efficiency of the solvent extraction step can increase by preventing the precipitation of impurities in the form of salts.

As described above, the present invention has been described with respect to particularly preferred embodiments. However, the present invention is not limited to the above embodiments, and it is possible for one who has an ordinary skill in the art to make various modifications and variations, without departing off the spirit of the present invention.

INDUSTRIAL APPLICABILITY

A nickel sulfate aqueous solution ($NiSO_4$), a cobalt sulfate aqueous solution ($CoSO_4$) and a manganese sulfate aqueous solution ($MnSO_4$) recovered by the present invention can be used as a key raw material in manufacturing of a cathode material for a lithium secondary battery.

The invention claimed is:

1. A solvent extraction method using two-stage extraction for separation and recovery of nickel, cobalt, and manganese, the method comprising:

preparing a raw material leachate containing nickel, cobalt, and manganese;

separating the manganese contained in the raw material leachate as a manganese sulfate aqueous solution; and separating the nickel and the cobalt contained in the raw material leachate from which the manganese is separated as a nickel sulfate aqueous solution and a cobalt sulfate aqueous solution, respectively;

wherein three types of valuable metals comprising the nickel, the cobalt, and the manganese are individually separated and recovered, and wherein the separating the manganese comprises:

adding the nickel sulfate aqueous solution to a first solvent to generate a manganese extracting solvent;

adding the raw material leachate to the manganese extracting solvent to separate the manganese extracting solvent into a first organic phase solution containing nickel, cobalt, and manganese and a first aqueous phase solution containing nickel and cobalt;

separating the first organic phase solution into a second organic phase solution containing manganese and a second aqueous phase solution containing nickel and cobalt;

back-extracting the manganese remaining in the second organic phase solution to separate the second organic phase solution into a third organic phase solution not containing manganese and a third aqueous phase solution containing manganese, thereby obtaining a manganese sulfate aqueous solution from the third aqueous phase solution; and back-extracting impurities contained in the third organic phase solution to separate the third organic phase solution into a fourth organic phase solution not containing impurities and a fourth aqueous phase solution containing the impurities.

2. The method of claim 1, wherein the preparing the raw material leachate comprises:

washing a starting material containing nickel, cobalt, and manganese with washing water;

separating the washed starting material into a starting material cake and a filtrate;

adding sulfuric acid to the starting material cake for reaction;

adding hydrogen peroxide and nickel hydroxide to reaction products formed through the adding the sulfuric acid to the starting material cake to precipitate an iron component; and separating the reaction products into a precipitate containing iron and the raw material leachate containing the nickel, the cobalt, and the manganese.

3. The method of claim 1, wherein the separating the nickel and the cobalt comprises:

adding the nickel sulfate aqueous solution to a second solvent to generate a nickel and cobalt extracting solvent;

adding the first aqueous phase solution containing the nickel and the cobalt to the nickel and cobalt extracting solvent to separate the nickel and cobalt extracting solvent into a fifth organic phase solution containing nickel and cobalt and a fifth aqueous phase solution containing nickel, thereby obtaining a nickel sulfate aqueous solution from the fifth aqueous phase solution;

separating the fifth organic phase solution into a sixth organic phase solution containing cobalt and a sixth aqueous phase solution containing nickel;

back-extracting the cobalt remaining in the sixth organic phase solution to separate the sixth organic phase solution into a seventh organic phase solution not containing cobalt and a seventh aqueous phase solution containing cobalt, thereby obtaining a cobalt sulfate aqueous solution from the seventh aqueous phase solution; and back-extracting impurities contained in the seventh organic phase solution to separate the seventh organic phase solution into an eighth organic phase solution not containing impurities and an eighth aqueous phase solution containing the impurities.

4. The method of claim 1, wherein the fourth organic phase solution obtained through the back-extracting the impurities contained in the third organic phase solution is reused as the first solvent in the adding the nickel sulfate aqueous solution to the first solvent.

5. The method of claim 3, wherein the eighth organic phase solution obtained through the separation of the back-extracting the impurities contained in the seventh organic phase solution is reused as the second solvent in the adding the nickel sulfate aqueous solution to the second solvent.

6. The method of claim 1, wherein a phosphoric extractant is used as the first solvent.

7. The method of claim 6, wherein the manganese extracting solvent has a pH adjusted to be in a range of 5.0 to 5.5 in the adding the nickel sulfate aqueous solution to the first solvent.

8. The method of claim 6, wherein a reaction is performed at a pH in a range of 4.5 to 5.0 in the adding the raw material leachate to the manganese extracting solvent.

9. The method of claim 6, wherein a reaction is performed at a pH in a range of 3.0 to 4.0 in the separating the first organic phase solution into the second organic phase solution.

10. The method of claim 6, wherein a reaction is performed at a pH in a range of 1.0 to 1.5 in the back-extracting the manganese remaining in the second organic phase solution.

11. The method of claim 3, wherein a phosphinic extractant or a phosphonic extractant is used as the second solvent.

12. The method of claim 11, wherein the nickel and cobalt extracting solvent has a pH adjusted to a range of 6.0 to 6.5 in the adding the nickel sulfate aqueous solution to the second solvent.

13. The method of claim 6, wherein a reaction is performed at a pH in a range of 5.5 to 6.0 in the adding the first aqueous phase solution.

14. The method of claim 3, wherein a reaction is performed at a pH in a range of 4.5 to 5.0 in the separating the fifth organic phase solution into the sixth organic phase solution.

15. The method of claim 6, wherein a reaction is performed at a pH in a range of 2.0 to 2.5 in the back-extracting the cobalt remaining in sixth organic phase solution.

16. The method of claim 3, further comprising:

recovering a first raffinate containing the nickel produced through the adding the nickel sulfate aqueous solution to the first solvent, a second raffinate containing the nickel produced through the adding the nickel sulfate aqueous solution to the second solvent, and the sixth aqueous phase solution produced through the separating the fifth organic phase solution into the sixth organic phase solution, to prepare nickel hydroxide.

17. The method of claim 16, wherein the nickel hydroxide produced through the recovering the first raffinate, the second raffinate and the sixth aqueous phase solution is used in adding hydrogen peroxide and the nickel hydroxide to reaction products.

18. The method of claim 2, wherein the starting material is one of a mixed hydroxide precipitate ($Me(OH)_2$), a mixed carbonate precipitate ($MeCO_3$), or a mixed sulfide or sulfate precipitate ($MeS$ or $MeSO_4$), where the Me is at least one of the nickel, the cobalt, or the manganese.

* * * * *